US010668727B2

(12) United States Patent
Wagner et al.

(10) Patent No.: US 10,668,727 B2
(45) Date of Patent: Jun. 2, 2020

(54) PRINTER CAP

(71) Applicant: HEWLETT-PACKARD DEVELOPMENT COMPANY, L.P., Houston, TX (US)

(72) Inventors: Jeffrey Allen Wagner, Vancouver, WA (US); Francisco Lopez Moral, Barcelona (ES); Maria Magdalena Martinez, Sant Cugat del Valles (ES); Xavier Bruch, San Cugat del Valles (ES); Chandrasekhar Nadimpalli, Barcelona (ES); Xavier Gasso Puchal, Barcelona (ES); Marian Dinares Argemi, Terrassa (ES); Ronald Albert Askeland, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 189 days.

(21) Appl. No.: 15/329,029

(22) PCT Filed: Jul. 30, 2014

(86) PCT No.: PCT/US2014/048964
§ 371 (c)(1),
(2) Date: Jan. 25, 2017

(87) PCT Pub. No.: WO2016/018322
PCT Pub. Date: Feb. 4, 2016

(65) Prior Publication Data

US 2017/0217185 A1 Aug. 3, 2017

(51) Int. Cl.

| | |
|---|---|
| ***B41J 2/165*** | (2006.01) |
| ***B41J 2/155*** | (2006.01) |
| ***B41J 29/38*** | (2006.01) |

(52) U.S. Cl.
CPC ..... *B41J 2/16505* (2013.01); *B41J 2/155* (2013.01); *B41J 29/38* (2013.01)

(58) Field of Classification Search
CPC ..... B41J 2/1605; B41J 2/155; B41J 29/38
See application file for complete search history.

(56) References Cited

U.S. PATENT DOCUMENTS 5,117,244 A * 5/1992 Yu ..... B41J 2/16508 347/29
5,625,385 A * 4/1997 Suzuki ..... B41J 2/16508 347/24

(Continued)

FOREIGN PATENT DOCUMENTS

| | | |
|---|---|---|
| JP | S59146857 | 8/1984 |
| JP | H05177841 | 7/1993 |
| JP | H05220967 | 8/1993 |

OTHER PUBLICATIONS

AMICA Systems. TL2024. http://www.nuvijet.com/products/show.php?lang=en&id=111>.

*Primary Examiner* — John Zimmermann
(74) *Attorney, Agent, or Firm* — Fabian VanCott (US LC)-USD

(57) ABSTRACT

A printing system may comprise a page wide array printhead a capping station, and a number of modular caps comprising a housing to cover a nozzle array of a printhead and a cap coupler coupled to the housing to couple the cap to the nozzle array in which the modular caps are adapted to be coupled to and removed from the nozzle array of the printhead and stored in the capping station.

20 Claims, 6 Drawing Sheets

(56) References Cited

U.S. PATENT DOCUMENTS

| | | | | |
|---|---|---|---|---|
| 5,870,115 | A | 2/1999 | Kikuchi et al. | |
| 5,992,964 | A | 11/1999 | Yamaguchi | |
| 6,334,664 | B1 | 1/2002 | Silverbrook | |
| 6,517,185 | B1 | 2/2003 | Aldrich | |
| 6,918,648 | B2 | 7/2005 | Tee et al. | |
| 7,029,093 | B2 | 4/2006 | Tee et al. | |
| 7,083,274 | B2 * | 8/2006 | Morita | B41J 2/155 347/104 |
| 7,246,874 | B2 * | 7/2007 | Hirakata | B41J 2/16585 347/29 |
| 7,334,862 | B2 * | 2/2008 | Kachi | B41J 2/16585 347/22 |
| 7,390,075 | B2 | 6/2008 | Silverbrook et al. | |
| 7,845,758 | B2 * | 12/2010 | Hayashi | B41J 2/16532 347/23 |
| 8,282,191 | B2 * | 10/2012 | Yoda | B41J 2/16511 347/33 |
| 8,517,504 | B2 | 8/2013 | Walker et al. | |
| 8,668,305 | B2 * | 3/2014 | Achatz | B41J 2/16508 347/29 |
| 8,845,071 | B2 * | 9/2014 | Yamamoto | B41J 2/16523 347/30 |
| 8,845,073 | B2 * | 9/2014 | Hawryschuk | B41J 2/155 347/34 |
| 8,911,059 | B2 * | 12/2014 | Tamaki | B41J 2/14233 347/35 |
| 2014/0340445 | A1 * | 11/2014 | Achatz | B41J 2/16505 347/32 |

* cited by examiner

PRINTER CAP

BACKGROUND

A printer may comprise a printhead through which an amount of fluid such as ink is deposited onto a substrate. The printhead may further comprise a number of dies with each die having a number of nozzles defined therein. A fluid supply is supplied to the printhead and the printhead allows an amount of the fluid to flow through the printhead to a fluid ejection device in a chamber defined in the printhead. The fluid ejection device ejects an amount of fluid out of the chamber, through a nozzle bore, and out the nozzle.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1A:
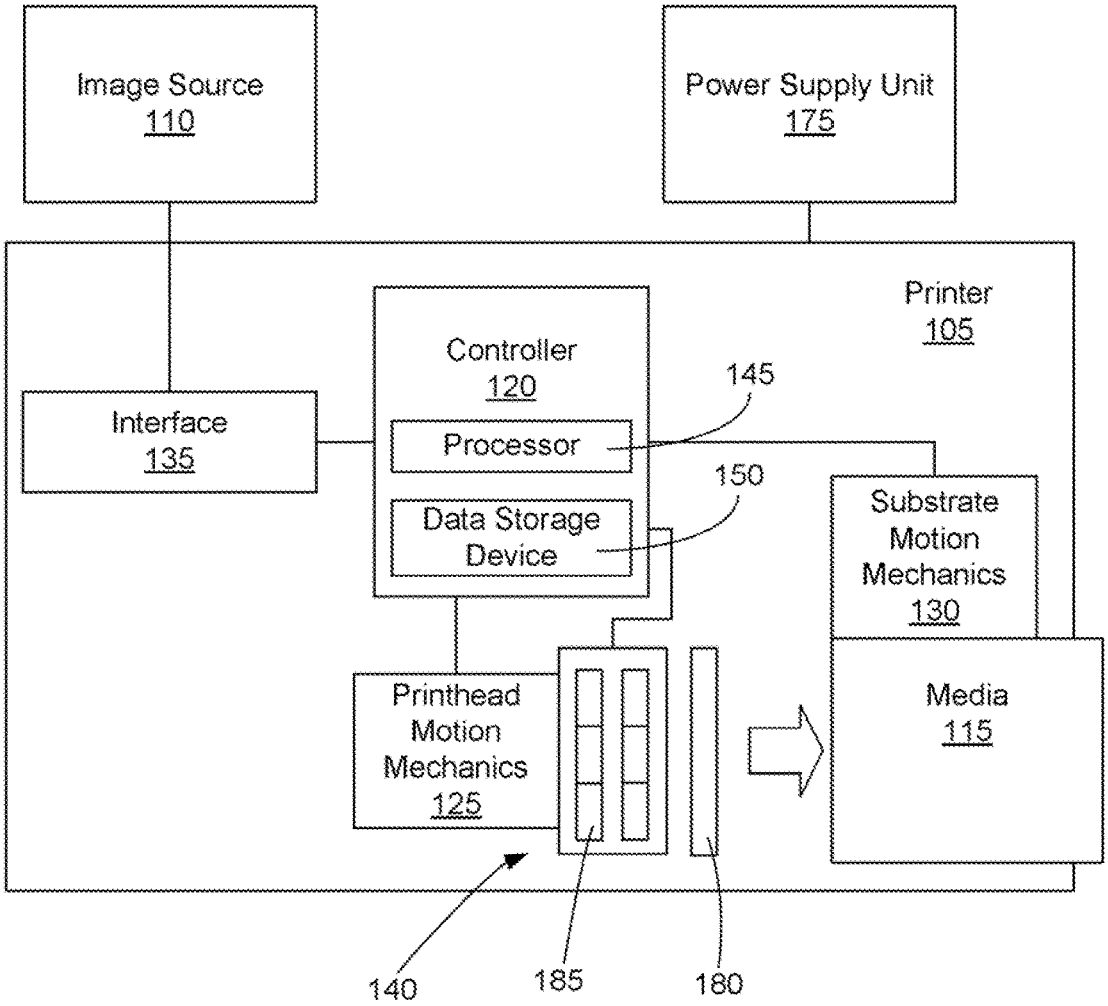
FIG. 1A is a block diagram of a printing system according to one example of the principles described herein.

As described above, the printhead comprises a number of paths through which a fluid may be culminated into an ejection chamber defined within the printhead and ejected through a nozzle bore and out of a nozzle. In one example, the fluid may be an ink and the selective ejection of the fluid onto a substrate may create an image Although many types of fluids may be ejected from the printhead, for convenience of description in the present specification, the fluid is described as an ink. Ink, like other fluids, comprises a number of chemical components that may evaporate leaving other components such as pigments in the nozzle bores that connect the nozzles to the firing chambers. This may cause a failure of the nozzle resulting in a poor quality of print or additional costs to replace the printhead.

The present specification, therefore, describes a printing system, comprising a page wide array printhead, a capping station, and a number of modular caps comprising a housing to cover a nozzle array of a printhead and a cap coupler coupled to the housing to couple the cap to the nozzle array in which the modular caps are adapted to be coupled to and removed from the nozzle array of the printhead and stored in the capping station.

The present specification further describes a printer with a printhead comprising a number of nozzle arrays, a capping station housing a number of caps, and a processor to instruct the capping station to selectively couple a first group of caps to a first subset of nozzle arrays while not coupling a second group of caps to a second subset of nozzle arrays in which the first group of caps is coupled to the first subset of nozzle arrays using a force provided by a coupling source that is relatively weaker than a force that is provided by an uncoupling source.

The present specification further describes a method for capping a printhead nozzle array, comprising coupling a number of caps to a first subset of nozzle arrays of a printhead using a coupling source that has a coupling force that is relatively weaker than an uncoupling force supplied by an uncoupling source used to uncouple the cap from the subset of nozzle arrays.

As used in the present specification and in the appended claims, the term "subset" "subset" is meant to be understood as any positive number of an object less than the total. For example, where a printhead comprises 10 dies, a subset of those dies would include 9 or less. Similarly, where a dies comprises 1200 nozzles, a subset of nozzles comprises 1199 or less nozzles.

Also, as used in the present specification and in the appended claims, the term "printer" is meant to be understood, broadly as any device capable of selectively placing a fluid onto a substrate. In one example the printer is an inkjet printer. In another example, the printer is a three-dimensional printer. In yet another example, the printer is a digital titration device.

Further, as used in the present specification and in the appended claims, the term "printhead" is meant to be understood broadly as a component of a printer that comprises a number of dies. In one example, the printhead comprises ail of the dies. In one example, the ten "printhead" comprises all modules of dies on a multi-printbar page wide array.

Additionally, as used in the present specification and in the appended claims, the term "substrate" is meant to be understood broadly as any surface onto which a fluid ejected from a nozzle of a printer may be deposited. In one example, the substrate may be paper. In another example, the substrate may be en edible substrate. In yet one more example, the substrate may be a medicinal pill.

Even further, as used in the present specification and in the appended claims, the term "fluid" is meant to be understood broadly as any substance that continually deforms under an applied shear stress. In one example, a fluid may be a pharmaceutical. In another example, the fluid may be an ink, in another example, the fluid may be a liquid.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1A is block diagram of a printing system according to one example of the principles described herein. The printing system may comprise a printer (105), an image source (110), and a media (115). The printer (105) may comprise a controller (120), printhead motion mechanics (125), substrate motion mechanics (130), an interface (135), and a printhead (140). The controller (120) may comprise a processor (145) and a data storage device (150). Each of these will now be described in more detail.

The printer (105) may comprise an interface (135) to interface with an image source (110). The interface (135) may be a wired or wireless connection connecting the printer (105) to the image source (110). The image source may be any source from which the printer (105) may receive data describing a print job to be executed by the controller (120) of the printer (105) in order to, for example, print an image onto the media (115). In one example, the image source may be a computing device communicatively coupled with the printer (105).

The interface (135) may also enable the printer (105) and specifically the processor (145) to interface with various hardware elements, such as the image source (110), external and internal to the printer (105). For example, the interface (135) may interface with an input or output device such as, for example, display device, a mouse, or a keyboard. The interface (135) may also provide access to other external devices such as an external storage device, a number of network devices such as servers, switches, and routers, client devices, other types of computing devices, and combinations thereof.

The processor (145) may include the hardware architecture to retrieve executable code from the data storage device (150) and execute the executable code. The executable code may, when executed by the processor (145), cause the processor (145) to implement at least the functionality of printing on the media (115), and actuating the printhead and substrate motion mechanics (125, 130), according to the methods of the present specification described herein. The executable code may, when executed by the processor (145), cause the processor (145) to implement the functionality of providing instructions to the power supply unit (175) such that the power supply unit (175) provides power to the printhead (140) to eject a fluid from a number of nozzles defined in the dies. In one example, the number of nozzles fired may be a number less than the total number of nozzles available and defined on the printhead (140).

The data storage device (150) may store data such as executable program code that is executed by the processor (145) or other processing device. The data storage device (150) may specifically store computer code representing a number of applications that the processor (145) executes to implement at least the functionality described herein.

The data storage device (150) may include various types of memory modules, including volatile and nonvolatile memory. For example, the data storage device (150) of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device (150) as may suit a particular application of the principles described herein. In certain examples, different types of memory in the data storage device (150) may be used for different data storage needs. For example, in certain examples the processor (145) may boot from Read Only Memory (ROM) (150), maintain nonvolatile storage in the Hard Disk Drive (HDD) memory, and execute program code stored in Random Access Memory (RAM).

Generally, the data storage device (150) may comprise a computer readable medium, a computer readable storage medium, or a non-transitory computer readable medium, among others. For example, the data storage device (150) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printhead and substrate motion mechanics (125, 130) comprise mechanical devices that may move the printhead (140) and media (115) respectively. Instructions to move the printhead (140) and media (115) may be received and processed by the controller (120) and signals may be sent to the printhead (140) and substrate motion mechanics (130) from the controller (120).

As discussed above, the printhead (140) may comprise a number of nozzles. In some examples, the printhead (140) may be broken up into a number of print dies (185) with each die (185) comprising a number of nozzles. In one example, the printhead (140) may have an array of nozzles defined therein without being grouped physically into dies. Thus, although the present specification describes the printhead as having a number of nozzles separated into dies (185), this is only meant to be one example in order to conveniently describe the printhead (140) and its functions. The printhead (140) may be any type of printhead including, for example, a cartridge or a wide array. These examples are not meant to limit the present description. Instead, various types of printheads may be used in conjunction with the present principles described herein.

The printer (105) may further comprise a capping station (180). The capping station (180) is a station where caps used to cap individual dies of the printhead (140) are maintained. In one example, the capping station (180) may be placed inline with the printhead (140) and media (115). In this example, the capping station (180) may be placed directly by the printhead (140) such that the capping station (180) may move relative to the printhead (140) and supply the printhead with the caps available at the capping station (180). In another example, the capping station (180) may be stationary and the printhead (140) moves relative to it in order to have access to the caps. In yet another example, the printhead (140) and the capping station (180) may both move allowing each to come closer to the other in order to supply the caps to the dies located on the printhead (140).

In still another example, the capping station (180) may be offline such that the printer (105) does not engage in any printing processes until a capping procedure using the capping station (180) is complete. In this example the printhead (140) may move relative to the capping station (180), the capping station (180) may move relative to the printhead, or both the capping station (180) and printhead (140) may move so as to engage.

As will be describe in more detail below, the printhead (140) operates with a number of dies being capped. Specifically, a first subset of the dies of the printhead (140) may be operating. Those dies may be allowed to print onto a substrate while a second subset of dies are capped and unused. In one example, the capped dies are those dies that comprise no nozzles that are to be fired during a printing process. In another example, the size of the media (115) being printed on determines which dies are capped and which dies are not capped. In yet another example, the position of the media (115) being printed on relative to the printhead (140) determines which dies are to be capped and which dies are not to be capped.

Figure 1B:
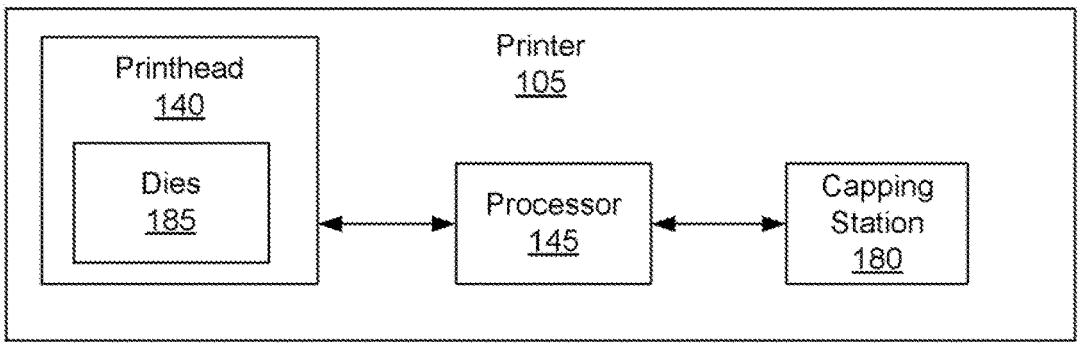
FIG. 1B is a block diagram of a printer according to an example of the principles described herein.

FIG. 1B is a block diagram of a printer (105) according to an example of the principles described herein. The printer (105) may comprise a printhead (140), a capping station (180), and a processor (145). As above, during operation, the processor (145) may direct the capping station (180) to apply a number of caps to a number of dies (185) of the printhead (140). The capping of the dies (185) prevents evaporation of the fluid such that the evaporation will not cause any nozzles of the dies to build up particulates therein thereby destroying the usefulness of the nozzle, die (185), and printhead (140).

Figure 2:
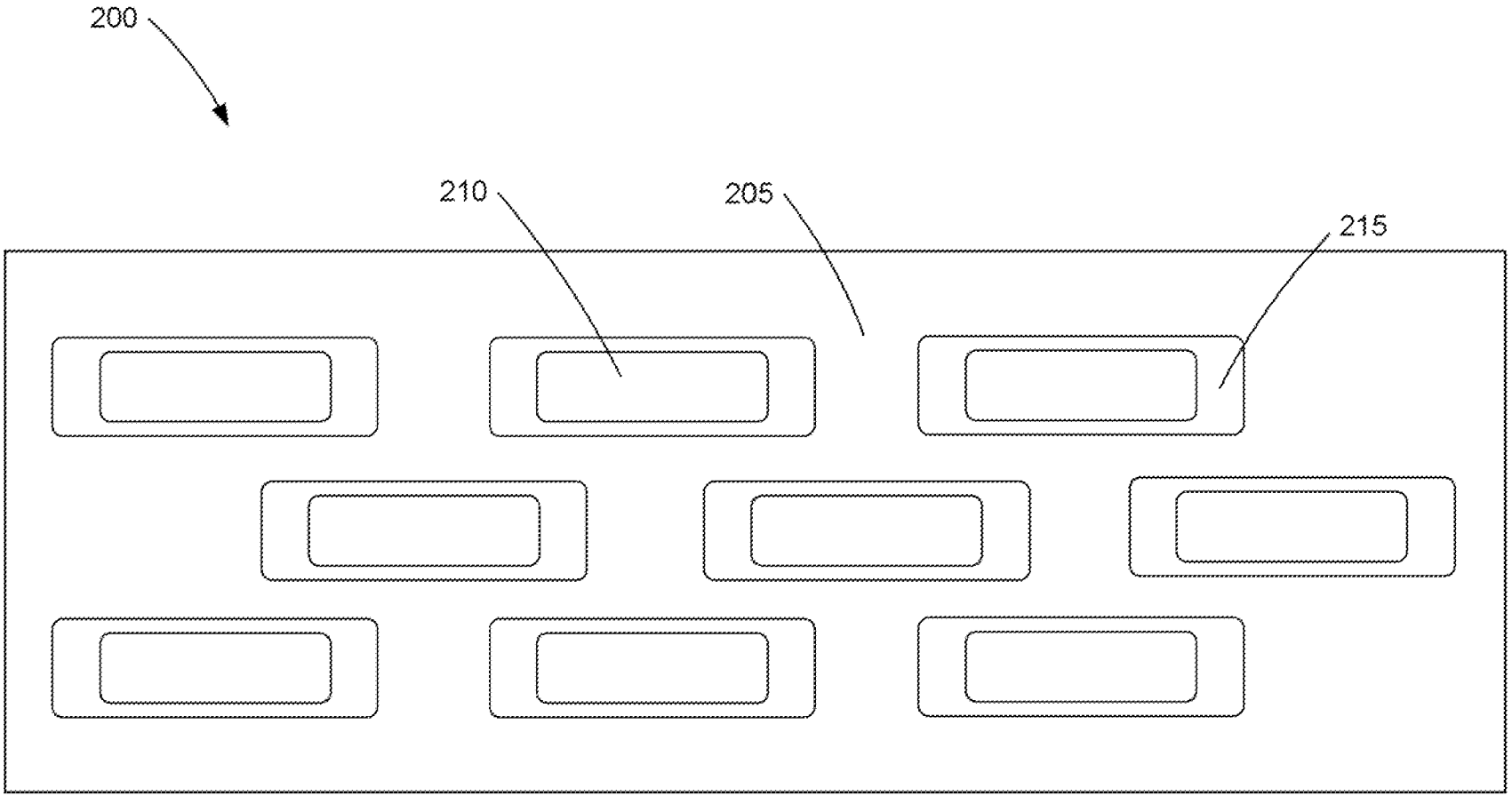
FIG. 2 is a top perspective of a capping station according to one example of the principles described herein.

FIG. 2 is a top perspective of a capping station (200) according to one example of the principles described herein. The capping station (200) may be similar to the capping station (FIG. 1, 180) of FIG. 1. The capping station (200) may comprise any surface (205) onto which a number of die caps (210) may be stored. The positioning of the die caps (210) on the surface (205) of the capping station (200) may be dependent on the position of the dies on the printhead (FIG. 1, 140). For example, FIG. 2 shows that the die caps (210) are positioned on the surface (205) of the capping station (200) in a staggered fashion. In this example, the corresponding positioning of the dies on the printhead (FIG. 1, 140) may be similarly staggered. This allows for the capping station (200) to be brought up to the printhead (FIG. 1, 140) such that the die caps (210) mirror the layout of the dies on the printhead. Although FIG. 2 shows the die caps (210) in a staggered pattern, the die caps (210) may be laid out in various configurations based on the position of the dies on the printhead (FIG. 1, 140). Additionally, the number of die caps (210) and corresponding number of dies is meant to be only an example. Any number of dies and corresponding die caps (210) may be used according to the principles described herein. Each cap (210) includes a cap coupler (215) to couple that cap to the printhead.

As described above, the capping station (200) may be inline. In one example the capping station (200) is placed directly below the printhead (FIG. 1, 140) such that during a pause in a printing process, before a printing process has commenced, or after a printing process has been completed, the capping station (200) may rise up to the printhead (FIG. 1, 140) and provide those die caps (210) to the printhead (FIG. 1, 140) that are to be coupled thereto. In one example, the processor (FIG. 1, 145) determines which dies on the printhead (FIG. 1, 140) are to be used for any specific print job. After determining which dies are to be capped before the printing process begins, the processor (FIG. 1, 145) may direct the capping station (200) to couple those corresponding die caps (210) to the dies so indicated.

Figure 3A:
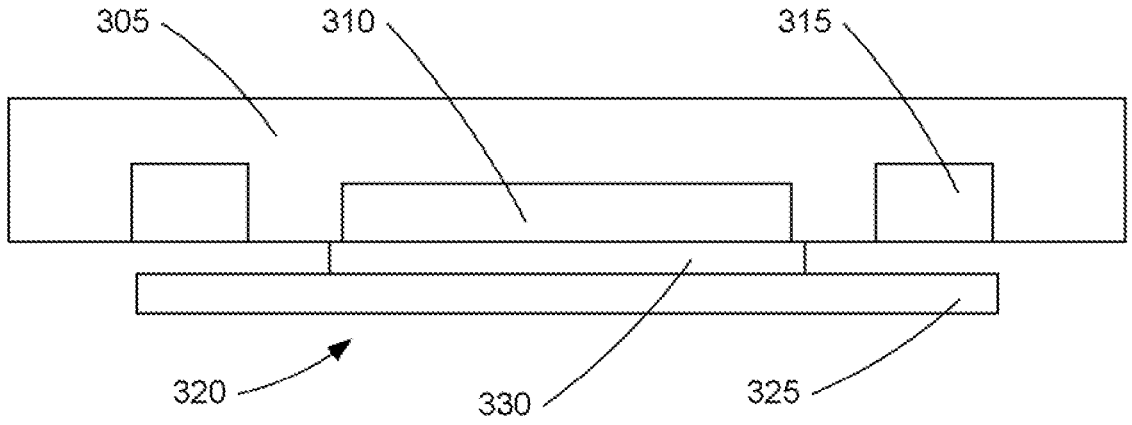
FIG. 3A is a block diagram of a die cap being attached to a printhead using magnets according to one example of the principles described herein.
Figure 3B:
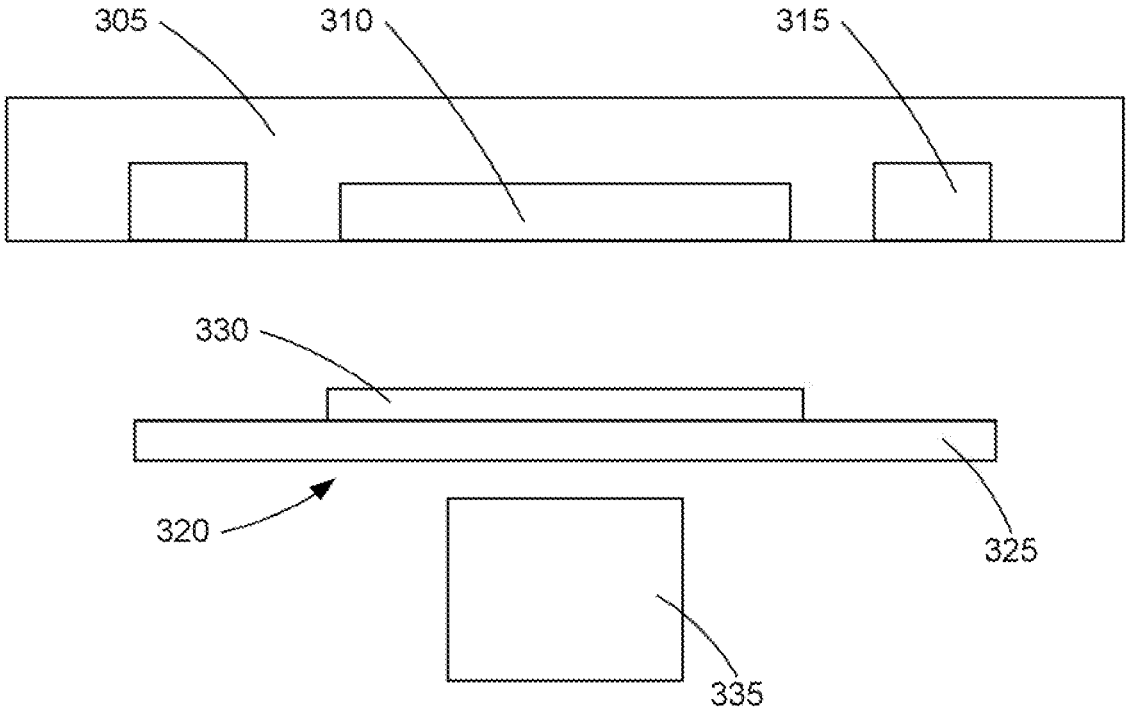
FIG. 3B is a block diagram of a die cap being removed form a printhead using magnets according to one example of the principles described herein.

The die caps (210) may be coupled to the printhead (FIG. 1, 140) using a number of methods. In one example, the die caps (210) are coupled to the printhead (FIG. 1, 140) using magnets. FIGS. 3A and 3B show a block diagram of a die cap being attached to and removed form a printhead respectively using magnets according to one example of the principles described herein. FIG. 3A shows a number of magnets (315) being incorporated into the printhead (305) and in proximity to the printhead die (310). In this example, the die cap (320) comprises a number of flanges (325) surrounding a sealing portion (330). The flanges (325) may be made of a ferromagnetic material that is attracted to the magnets (315) in the printhead (305). The attraction causes the die cap (320) to seal off the die and cap it until the die cap (320) is removed.

Selective removal of the die cap (320) is shown in FIG. 3B. In FIG. 3B, an electromagnet is introduced below the die cap (320). Again, because the die cap is made of a ferromagnetic material, the electromagnet is able to overcome the magnetic forces of the magnets (315) and pull the die cap (320) away from the die (310). In an alternative example, the printhead (305) may be made of a ferromagnetic material and the flanges (325) may comprise a number of magnets similar to those magnets shown in FIGS. 3A and 3B. Similar to above, removal of the die cap (320) may be accomplished through the use of an electromagnet (335). In either of these examples, the electromagnet (335) may form part of the capping station (FIG. 2, 200) as described in FIG. 2 with each die cap (320) being removed from an individual electromagnet (335) residing in the location where the die cap (320) is to be placed in the capping station (FIG. 2, 200).

In yet another example, the die cap may be coupled to the die using a fastening device such as a clip. The capping station (FIG. 2, 200) comprises a fastening device that is made to fasten and unfasten the die caps (210) to and from the die. Thus, although FIGS. 3A and 3B show the use of a magnet, the present specification contemplates the use of many other coupling devices that may be used to couple the die caps (210) to their respective dies and the examples provided here are not mean to limit the scope of this disclosure.

Figure 4A:
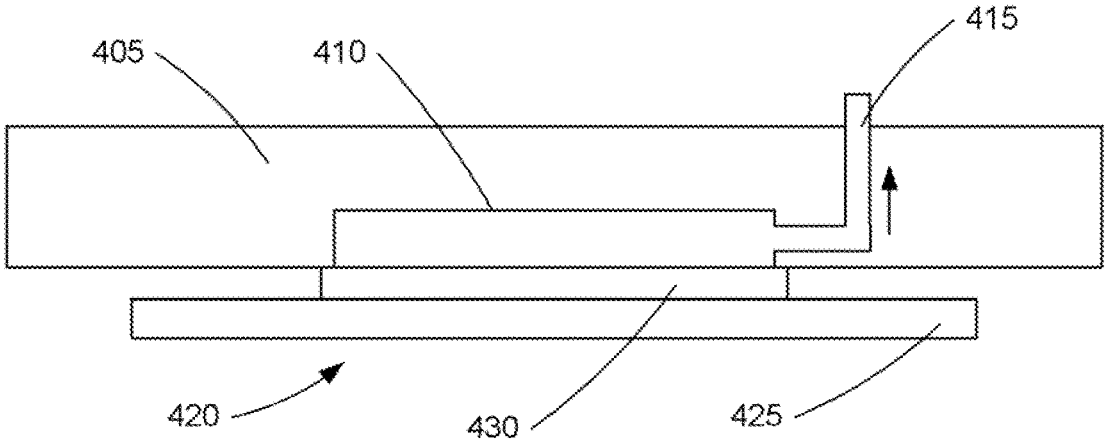
FIG. 4A is a block diagram of a die cap being coupled to a printhead using a vacuum device according to another example of the principles described herein.
Figure 4B:
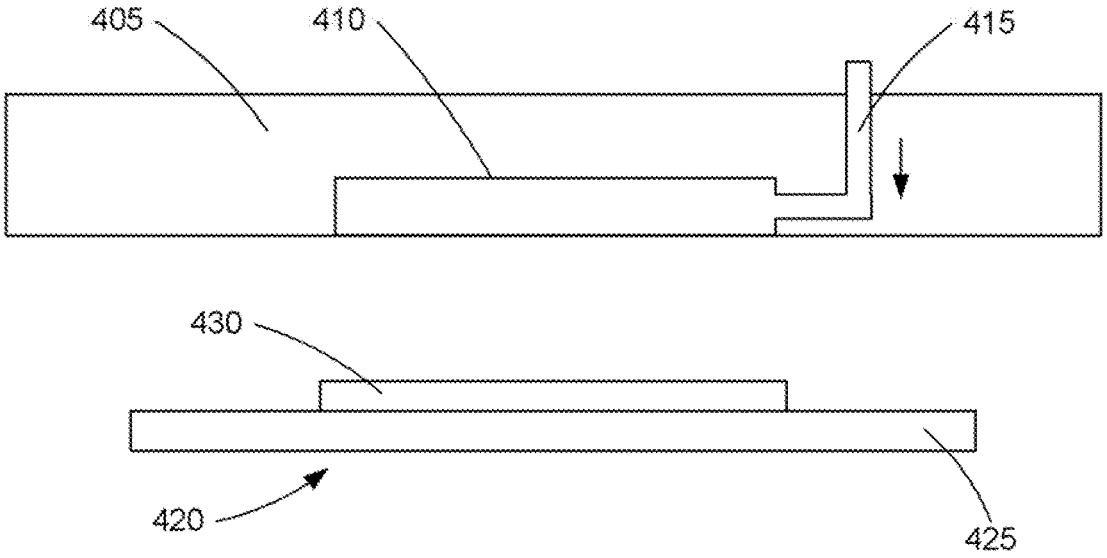
FIG. 4B is a block diagram of a die cap being removed form a printhead using a vacuum device according to another example of the principles described herein.

FIGS. 4A and 4B are block diagrams of a die cap being coupled to and removed form a printhead respectively using a vacuum device according to one example of the principles described herein. In this example, the die cap (420) may be coupled to the die (410) using the above described magnetic system, a vacuum pressure, or combinations thereof. During a capping procedure, the capping station (FIG. 2, 200) may cause the individual die caps (420) to come in contact with the die (410). When this occurs, a negative pressure may be applied to the fluid channels (415) of the die (410). As this negative pressure is created, a vacuum forms between the sealing portion (430) of the die cap (420) and the die. The negative pressure is maintained until the die cap (420) is to be removed. In FIG. 3B, the negative pressure is released and the die cap (420) is uncoupled from the die (410). In one example, the capping station (FIG. 2, 200) is present under the die cap (420) when the pressure is released such that the die cap (420) is placed in the capping station (FIG. 2, 200) at a specific location.

Figure 5:
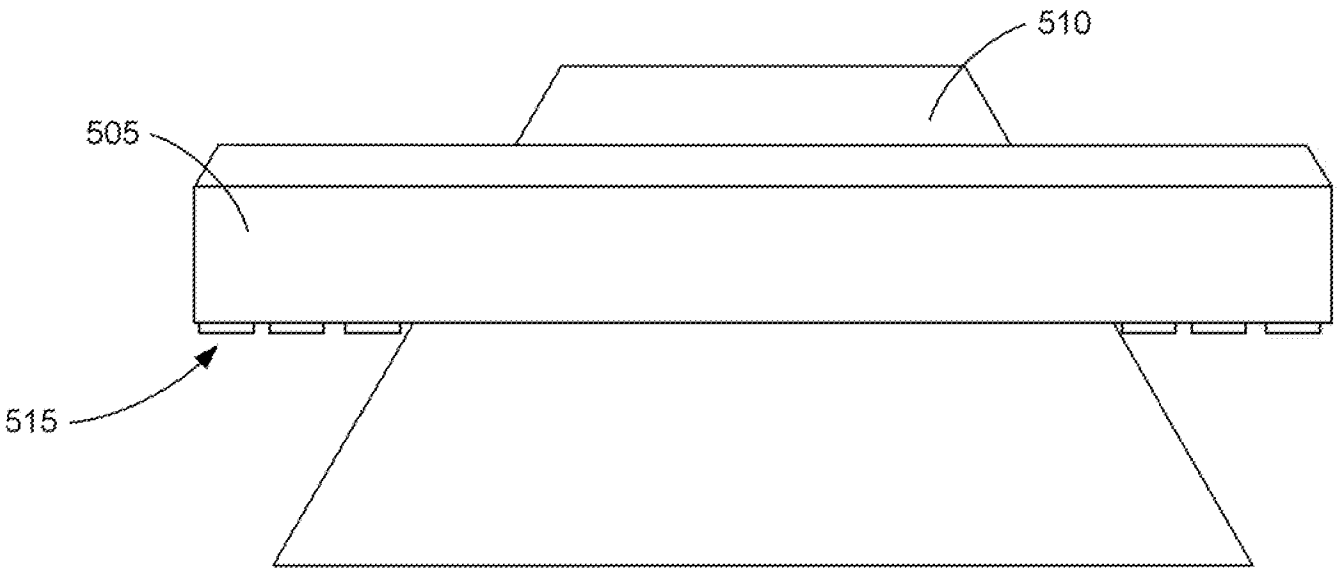
FIG. 5 is a perspective view of a printhead and media according to one example to of the principles described herein.

FIG. 5 is a perspective view of a printhead (505) and media (510) according to one example to of the principles described herein. As described above, the printhead (505) may operate with a number of die caps (515) in place while other die caps (515) are not. In one example, the die caps (515) coupled to any die on the printhead (505) may be determined previously by the processor (FIG. 1, 145). The processor (FIG. 1, 145) may receive a print job at the printer (FIG. 1, 105) from, for example, the image source (FIG. 1, 110). The processor (FIG. 1, 145) may evaluate the characteristics of the print job including the image data, the size of media to produce a printed copy of the image data onto, the colors of ink used to produce an image, among others. Upon evaluating the characteristics of the image data, the processor (FIG. 1, 145) may direct the capping station (FIG. 2, 200) to add or remove a number of die caps (515) according to which dies (FIGS. 3A and 3B, 310; FIGS. 4A and 4B, 410) will be used to add an amount of jettable fluid to the media (810). In one example, where the width of a printhead (505) such as a wide array is wider than the width of the media (510), a number of dies (FIGS. 3A and 3B, 310; FIGS. 4A and 4B, 410) on the edge or edges of the wide array printhead (505) may be capped. This example can be seen in FIG. 5. As described above, the capping of unused dies (FIGS. 3A and 3B, 310; FIGS. 4A and 4B, 410) during printing prevents any damage to the nozzles of the individual dies (FIGS. 3A and 3B, 310; FIGS. 4A and 4B, 410). When a nozzle is subjected for long periods of time to ambient air, the fluid within the nozzles may evaporate leaving an amount of non-evaporative components in the nozzles. This may cause contamination of the nozzle bores and eventual failure of the nozzle to eject any fluid. In some examples, this may cause a single die (FIGS. 3A and 3B, 310; FIGS. 4A and 4B, 410) to be replaced. In other examples, because a number of dies (FIGS. 3A and 3B, 310; FIGS. 4A and 4B, 410) are incorporated into a single module, the destruction of a single nozzle may cause the replacement of a whole module. In the latter case, the cost of replacing an entire module may be relatively significant. Additionally, separate costs may be incurred when the printer (FIG. 1, 105) is taken offline for maintenance. These costs may include loss of production, costs in paying for the repair, loss of potential future work, among others.

Although FIGS. 3A and 4A show a die cap being coupled to the printhead using a magnetic force or a vacuum force respectively, these are merely examples. Therefore, present specification further contemplates the use of other forces, mechanisms, or combinations thereof to couple the cap to the printhead in order to cover a number of nozzles. In one example, a number of suction cups may be used to secure a cap the surface of the printhead. In another example, a mechanical latch may be used to secure the cap to the printhead. In yet another example, a pneumatic system may be used to couple the cap to the surface of the printhead.

Figure 6:
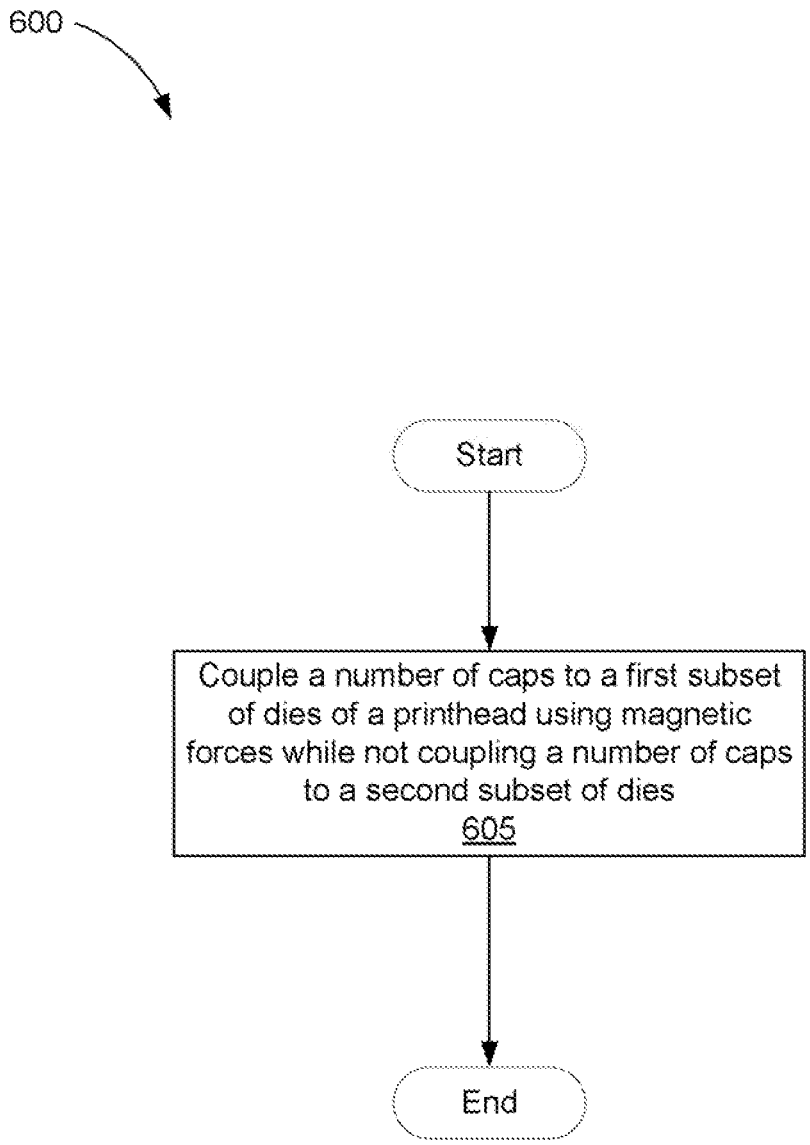
FIG. 6 is a flowchart showing a method for capping a printhead die according to one example of the principles described herein.

FIG. 6 is a flowchart showing a method for capping a printhead die according to one example of the principles described herein. The method may begin with coupling a number of caps to a first subset of dies of a printhead while not coupling a number of caps to a second subset of dies. As described above, the coupling (505) of the die caps (210) to the dies (FIGS. 3A and 3B, 310, FIGS. 4A and 4B, 410) may be accomplished by a capping station (FIG. 2, 200).

The present method may further be implemented as a computer program product for capping a printhead die. In one example, the computer program product for capping a printhead die comprises a computer readable storage medium comprising computer usable program code embodied therewith, the computer usable program code comprising computer usable program code to, when executed by a processor (FIG. 1, 145), couple a number of caps to a first subset of dies of a printhead while not coupling a number of caps to a second subset of dies. Again, the coupling (FIG. 6, 605) may be accomplished through the use of a capping station (FIG. 2, 200) actuated by direction of the processor (FIG. 1, 145).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (FIG. 1, 145) of the printer (FIG. 1, 105) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a printer cap and a method of coupling and uncoupling the cap to a die of a printhead. Application of the cap to the dies prevents destruction of the nozzles of the dies due to evaporation of the fluid in the nozzles. Additionally, the cap may be selectively coupled to a first subset of dies on a single printhead while being left off of a second subset of dies. This allows the printhead to still be used while the not damaging unused dies.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing system, comprising:

a printhead comprising a plurality of print die;

printhead motion mechanics;

a capping station; and a number of modular caps, each cap comprising a housing to cover a nozzle array of one of the print die of the printhead and a cap coupler coupled to the housing to couple the cap to the nozzle array;

in which the modular caps are selectively and individually coupled to and removed from respective nozzle arrays of the printhead and stored in the capping station, wherein, when one of the modular caps is coupled to the printhead, that modular cap leaves the capping station and remains on the printhead while the printhead is moved by the printhead motion mechanics until that modular cap is returned to the capping station and released from the printhead.

2. The printing system of claim 1, in which each modular cap covers a single print die so that, when the printhead is operating, a first subset of nozzle arrays among the plurality of nozzle arrays is capped with modular caps while a second subset of nozzle arrays among the plurality of nozzle arrays remains uncapped.

3. The printing system of claim 2, in which one of the modular caps covers a first nozzle array among the plurality of nozzle arrays while a second nozzle array among the plurality of nozzle arrays remains uncapped during a printing process.

4. The printing system of claim 1, in which each modular cap further comprises a number of flanges to which a magnet is coupled to magnetically couple the cap to the printhead.

5. The printer cap of claim 1, in which the printing system further comprises a negative pressure generator that generates a negative pressure between each coupled nozzle array and the cap sufficient to create a vacuum between the cap and the nozzle array.

6. The printing system of claim 5, in which the negative pressure generator places a negative pressure on a number of fluid chambers defined in the printhead.

7. A printer, comprising:

a printhead comprising a number of nozzle arrays, each nozzle array being on a separate print die within the printhead;

a capping station housing a number of caps; and a processor to instruct the capping station to selectively couple a first group of caps to a first subset of nozzle arrays while not coupling a second group of caps to a second subset of nozzle arrays, the second subset of nozzle arrays being those that are used to print fluid onto a substrate for form an image according to image data during a printing process, each cap comprising a coupler that, when engaged, retains the cap on the printhead during printing of the image by the printhead.

8. The printing system of claim 1, wherein each cap coupler, when engaged, retains a respective modular cap on the printhead during release of a print fluid onto a substrate by the printhead.

9. The printer of claim 7, in which each cap further comprises a number of flanges to which a number of magnets are coupled and in which the capping station couples a cap from the first group of caps to one of the nozzle arrays of the first subset of nozzle arrays using the magnetic force of the magnets.

10. The printer of claim 7, in which the printer causes the capping station to cap or uncap a nozzle array based on the width of a printing media to be printed on.

11. The printer of claim 7, in which the printhead further comprises a pressure generator that generates a negative pressure between the first subset of nozzle arrays and the cap sufficient to create a vacuum between the cap and the first subset of nozzle arrays.

12. The printer of claim 11, in which the pressure generator places a negative pressure on a number of fluid chambers defined in the printhead to secure a number of caps to a number of nozzle arrays.

13. The printer of claim 11, in which the pressure generator places a positive pressure on a number of fluid chambers defined in the printhead to remove a number of caps from the number of nozzle array.

14. A method for operating the printing system of claim 1 for capping print die of the printhead, comprising:

coupling a number of the modular caps to a first subset of print die of the printhead using a coupling source that has a coupling force that is relatively weaker than an uncoupling force supplied by an uncoupling source used to uncouple the number of caps from the subset of print die.

15. The method of claim 14, in which the first subset of print die remains capped while a second subset of print die remains uncapped during a printing procedure.

16. The printer of claim 7, wherein the printhead is a page-wide printhead with print die spanning a width of a print substrate.

17. The printer of claim 7, wherein the printing system selectively caps print die at edges of the printhead based on a width of a substrate on which the printing system will print.

18. The printing system of claim 1, wherein the modular caps, when located in the capping station, are arranged in a staggered pattern corresponding to a staggered pattern of the print die on the printhead.

19. The printing system of claim 1, wherein each modular cap comprises a magnet for coupling that cap to the printhead, the printing system further comprising an electromagnet for removing caps from the printhead.

20. The printing system of claim 1, wherein each modular cap comprises a clip to selectively and releasably attach that cap to the printhead.

* * * * *